US005353700A

United States Patent [19]

Privin

[11] Patent Number: 5,353,700

[45] Date of Patent: Oct. 11, 1994

[54] MAILING MACHINE INCLUDING MOVABLE INKING CARTRIDGE

[75] Inventor: David Privin, Stamford, Conn.

[73] Assignee: Pitney Bowes Inc., Stamford, Conn.

[21] Appl. No.: 703,306

[22] Filed: May 20, 1991

[51] Int. Cl.[5] ..... B41F 31/00

[52] U.S. Cl. ..... 101/91; 101/103; 101/329; 101/348

[58] Field of Search ..... 101/348, 349, 359, 335, 101/324, 91, 36, 329, 327, 328, 103, 364, 367, 330, 352; 400/197, 202, 202.2, 202.3, 202.4; 401/218

[56] References Cited

U.S. PATENT DOCUMENTS

| | | | |
|---|---|---|---|
| 1,190,640 | 7/1916 | Graham | 400/202.4 X |
| 3,601,049 | 8/1971 | Hamilton | 101/350 |
| 3,662,682 | 5/1972 | Marozzi | 101/219 |
| 4,051,781 | 10/1977 | Nishikawa | 101/348 |
| 4,145,967 | 3/1979 | Marozzi | 101/333 |
| 4,152,984 | 5/1979 | Utzinger | 101/292 |
| 4,213,389 | 7/1980 | Sato | 101/295 |
| 4,440,083 | 4/1984 | Hooper | 101/348 |
| 4,580,496 | 4/1986 | Buan | 101/348 |
| 4,697,517 | 10/1987 | Fassman | 101/348 |
| 4,699,054 | 10/1987 | Scrudato | 101/330 |
| 4,747,713 | 5/1988 | Kikuchi | 400/202.4 |
| 4,817,526 | 4/1989 | Winston | 101/329 |
| 4,864,505 | 9/1989 | Miller | 364/464.02 |
| 5,109,769 | 5/1992 | Wright, Jr. | 101/329 |

FOREIGN PATENT DOCUMENTS

| | | | |
|---|---|---|---|
| 210755 | 2/1987 | European Pat. Off. | 400/202.4 |
| 2140352 | 11/1984 | United Kingdom | 101/330 |
| 2145975 | 4/1985 | United Kingdom | 400/197 |

*Primary Examiner*—Edgar S. Burr
*Assistant Examiner*—Eric P. Raciti
*Attorney, Agent, or Firm*—Robert H. Whisker; Melvin J. Scolnick

[57] ABSTRACT

A mailing machine including a base; a postage meter removably mountable on the base; the base and meter respectively including structure for guiding the meter in a path of travel to a predetermined position on the base when mounting the meter thereon; and a disposable inking cartridge having a generally rectangularly-shaped hollow housing movably connected to the base, the housing having opposed side walls and having an elongate perimeter edge wall extending between the side walls, each of the side walls including an arcuately-shaped cam surface oppositely spaced from the cam surface of the other side wall, the cam surfaces and edge wall defining a substantially arcuately-shaped aperture formed in the housing; and a transfer roller impregnated with printing ink and rotatably connected to the side walls so as to extend therebetween and be accessible via the housing aperture, the cam surfaces located in the path of travel of the meter for engagement thereby to move the housing out of the path of travel and carry therewith the transfer roller as the postage meter is mounted on the base.

20 Claims, 4 Drawing Sheets

MAILING MACHINE INCLUDING MOVABLE INKING CARTRIDGE

BACKGROUND OF THE INVENTION

This invention is generally concerned with a mailing machine including an inking cartridge and a removably mountable postage meter, and more particularly with a mailing machine including an inking cartridge which is movable by the postage meter when the meter is mounted on the mailing machine.

This Application is related to the following concurrently filed, U.S. patent applications filed by the same inventor, i.e. David Privin, and assigned to the same assignee: Ser. No. 07/703315 for a Mailing Machine Having A Disposable Inking Cartridge, Ser. No. 07/703315 for an Inking Cartridge.

As shown in U.S. Pat. No. 4,697,517 for Inking Apparatus For A Mailing Machine, issued Oct. 6, 1987 to Arnold Fassman and assigned to the assignee of the present invention, there is disclosed a mailing machine which includes a base, and includes an inking cartridge and postage meter which are removably connectable to the base. The inking cartridge includes an ink impregnated roller, known in the art as a reservoir roller, and the base includes an ink impregnated roller known in the art as a transfer roller. When the inking cartridge is connected to the base, the reservoir roller is disposed in rolling engagement with the transfer roller and, assuming the postage meter is mounted on the base, when the mailing machine is operated, the meter's printing drum rotates into engagement with the transfer roller for transferring ink therefrom to the printing drum as the reservoir roller replenishes the ink supply of the transfer roller. In order to locate the postage meter in sufficiently close proximity to the transfer roller to permit the transfer of ink therefrom to the printing drum, the meter and base are complementarily configured for guiding the meter to a predetermined position on the base wherein the meter is disposed in close proximity to the transfer roller. As a result, in the course of mounting the meter on the base, it is substantially impossible to prevent the meter from contacting the ink transfer roller and smearing ink therefrom on to the meter. To cure this problem, Fassman discloses the provision of a cam member, coaxially connected to and pivotable about the opposite end journals of the transfer roller, which has cam surfaces radially extending beyond the outer periphery of the ink transfer roller. In the course of mounting the meter on the base, the meter engages and moves the cam, and thus the transfer roller, away from the meter to prevent ink from the transfer roller from being smeared on to the meter. Accordingly:

- an object of the invention is to provide improved letter processing apparatus;
- another object is to provide a mailing machine with an inking cartridge which is movable by the meter in the course of mounting the meter on, and dismounting the meter from, the mailing machine; and
- another object is to provide a mailing machine, which includes a postage meter removably connectable thereto, with an inking cartridge which includes a transfer roller and includes structure which is engaged by the meter for moving the inking cartridge, and thus the transfer roller, away from the meter when the meter is mounted on, and dismounted from, the machine.

SUMMARY OF THE INVENTION

A mailing machine comprising: a base; a postage meter removably mountable on the base; the base and meter respectively including means for guiding the meter in a path of travel to a predetermined position on the base when mounting the meter thereon; and a disposable inking cartridge comprising: a generally rectangularly-shaped hollow housing movably connected to the base, the housing having opposed side walls and having an elongate perimeter edge wall extending between the side walls, each of the side walls including an arcuately-shaped cam surface oppositely spaced from the cam surface of the other side wall, the cam surfaces and edge wall defining a substantially arcuately-shaped aperture formed in the housing; and a transfer roller impregnated with printing ink and rotatably connected to the side walls so as to extend therebetween and be accessible via the housing aperture, the cam surfaces located in the path of travel of the meter for engagement thereby to move the housing out of the path of travel and carry therewith the transfer roller as the postage meter is mounted on the base.

BRIEF DESCRIPTION OF THE DRAWINGS

As shown in the drawings wherein like references numerals designate like or corresponding parts throughout the several views.

DESCRIPTION OF THE PREFERRED EMBODIMENTS

Figure 1:
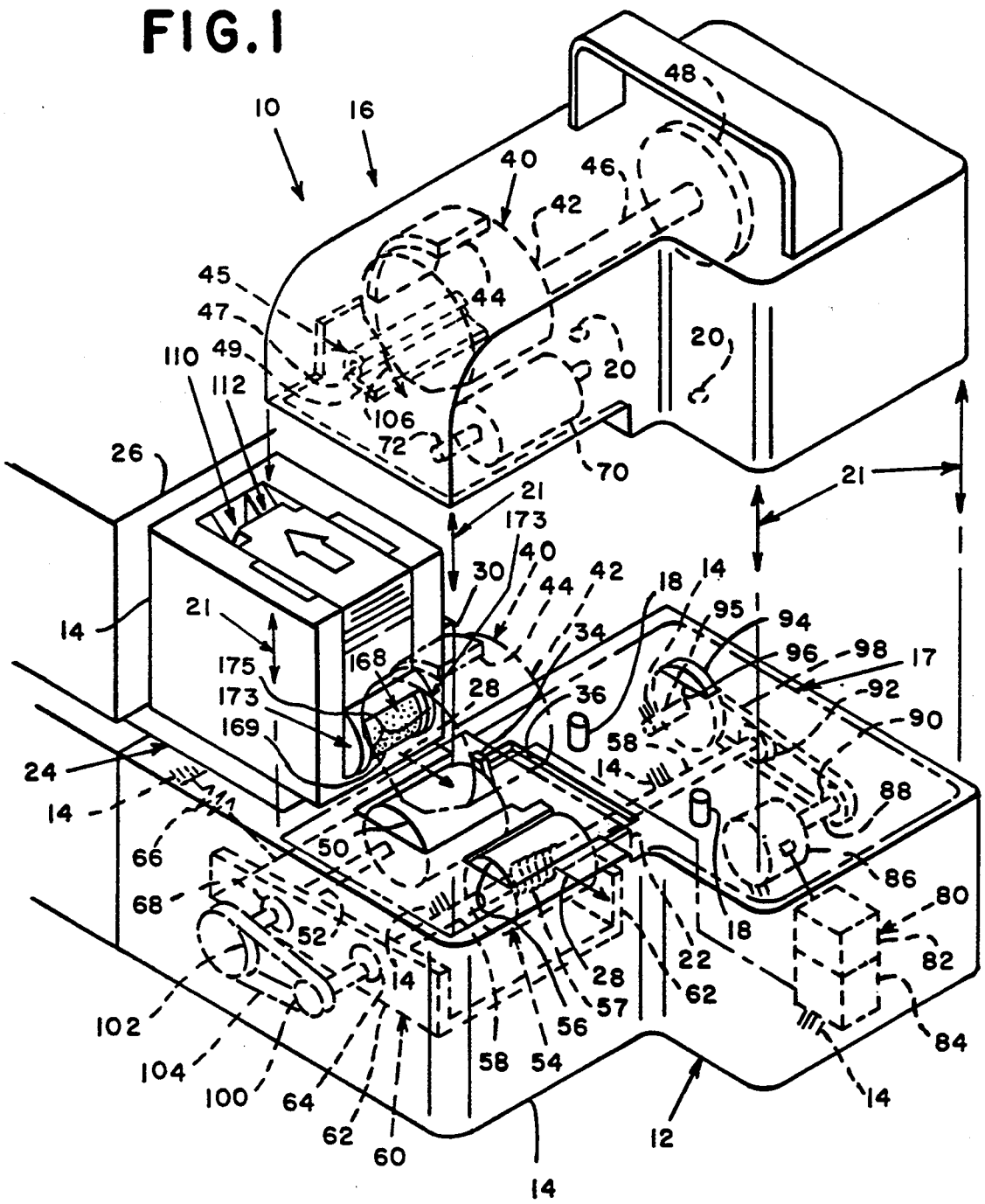
FIG. 1 is a partially fragmented, partially exploded, perspective view of a mailing machine comprising a base having connected thereto a removably mounted inking cartridge which includes a transfer roller, and comprising a postage meter which is removably mountable on the base.

As shown in FIG. 1, the letter processing apparatus in which the invention is incorporated comprises a mailing machine 10 which generally includes a base 12, having a housing 14, and a postage meter 16. For removably mounting the meter 16 in a predetermined position 17 on the base 12, the base 12 includes a plurality of posts 18 and the meter 16 includes a like number of apertures 20. The posts 18 and apertures 20 are complementarily configured and respectively dimensioned for engagement with, and disengagement from, one another for guiding the meter 16 in a predetermined, preferably vertically-extending, path of travel 21 relative to the base 12, in the course of mounting the meter 16 in, or dismounting the meter 16 from, the predetermined position 17. When mounted on the base 12, the postage meter 16 forms therewith a slot 22, through which letters 24, including sheets, mailpieces, envelopes and cards, and the like, are fed to the machine 10, either by hand or by means of suitable feeding apparatus 26, for feeding thereby in a downstream path of travel 28. The base 12 additionally comprises aligning structure including a registration fence 30 against which an edge of a given letter 24 is normally urged when fed to the mailing machine 10. Further, the base 12 includes structure for sensing letters 24 fed to the machine 10, including a trip lever 34 which extends upwardly through a housing aperture 36 and into the path of travel 28 of letters 24 fed to the machine 10.

The postage meter 16 (FIG. 1) comprises printing structure 40 including a rotary printing drum 42 having a conventional postage printing die 44 peripherally extending therefrom, and having other conventional structure (not shown) extending therefrom, for engaging respective letters 24 beneath the drum 42 and feeding the letters 24 downstream in the path of travel 28 as the printing die 44 prints postage indicia thereon. In addition, the meter 16 includes a shaft 46, extending from the drum 42, and a drive gear 48, mounted on the shaft 46 for rotation thereof and thus of the printing structure 40.

For protecting the printing structure 40 from inadvertent damage occasioned by handling the postage meter 16, the meter 16 preferably includes guard structure 45 which is conventionally connected to the meter 16 beneath and laterally to one side of the printing structure 40. The guard structure 45 preferably includes an elongate rod 47, having the opposite ends thereof suitably fixedly secured to the meter 16. The rod 47 extends substantially parallel to the drum drive shaft 46 and is radially spaced from and beneath the drum 42. In addition, the guard structure 45 includes an elongate, generally rectangularly-shaped, shield member 49, having a longitudinally extending marginal edge portion thereof which is conventionally wrapped about the rod 47 for connection thereto. As thus constructed and arranged the shield member 49 laterally extends from the rod 47 and beneath the printing structure 40.

The base 12 (FIG. 1) includes an input feed roller 50, known in the art as an impression roller, and a shaft 52 on which the impression roller 50 is mounted for rotation. The shaft 52 is preferably resiliently connected to the housing for movement toward and away from the drum 42, as hereinafter discussed, to permit the impression roller 50 to yieldably extend upwardly through the housing aperture 36, and into the path of travel 28, for urging respective letters 24 into printing engagement with the printing die 44. The base 12 additionally includes a conventional ejection roller 54, which includes a cylindrically-shaped outer member 56 and a coaxially-extending coil spring 57 having one end connected thereto. And the base 12 includes an drive shaft 58, extending coaxially of the roller 54, on which the outer roller member 56 is rotatably mounted and to which the other end of the spring 57 is connected for transmitting drive to the outer roller member 56 and thus to the roller 54.

For resiliently connecting the impression roller 50 (FIG. 1) to the housing 14, the base 12 may include any suitable structure 60, such as a pair of parallel-spaced, interconnected, pivot arms 62 having one end thereof conventionally rotatably connected to the ejection roller shaft 58 as by means of bearings 64, one of which is shown, and having the other ends resiliently connected to the housing 14, by means of a depending spring 66, and provided with bearings 68 for rotatably supporting the impression roller shaft 52. As thus constructed and arranged, when the impression roller 50 is urged downwardly, the shaft 52 is lowered against the resilient force exerted by the spring 66 to provide a variable gap between the drum 42 and impression roller 50, to accommodate mixed thickness letters 24. And, the spring 66 resiliently urges the impression roller 50 upwardly against the downward force exerted by a given letter 24 fed beneath the drum 42, for urging the given sheet 24 into printing engagement with the printing die 44. To further accommodate feeding mixed thickness letter 24 through the machine 10, the postage meter 16 preferably includes a suitable idler roller 70, conventionally mounted for rotation on a shaft 72 which is suitably resiliently mounted to yieldably support the roller 70 above the ejection roller 54 for receiving therebetween mixed thickness letters 24.

In addition, the base 12 (FIG. 1) includes an intermittently operable system 80 for driving the drum drive gear 48, and thus the drum 42, the impression roller shaft 52, and thus the impression roller 50, and the ejection roller shaft 58, in timed relationship with one another in response to movement of the trip lever 34 by a letter 24 fed to the machine 10. The driving system 80 includes suitable control structure 82 and trip structure 84, which are respectively conventionally connected to the housing 14. The trip structure 84 is suitably connected between the trip lever 34 and control structure 82 for providing conventional input thereto indicative that a letter 24 has been fed to the machine 10. The drive system 80 also includes a motor 86, which is conventionally connected to the control structure 82 for operation thereof in response to conventional input from the trip structure 84, and which has an output shaft 88. In addition, the drive system 80 includes a pinion gear 90, mounted on the output shaft 88, and a drive gear 92, mounted on the ejection roller shaft 58. Further the drive system 80 includes a drive gear 94, which is conventionally rotatably connected to the housing 14, as by means of a shaft 95 suitably rotatably connected thereto, and protrudes upwardly therefrom through an aperture 96 formed in the housing 14 for disposition in meshing engagement with the drum drive gear 48 when the postage meter 16 is mounted on the base 12. Moreover, the drive system 80 includes a drive gear (not shown), which is conventionally fixedly attached to the drive gear 94, and a gear belt 98 looped thereabout and about the pinion gear 90 for transmitting motor drive from the pinion gear 90 to the drive gear 94, and thus to the postage meter drum 42. Still further, the drive gear 92 is disposed in meshing engagement with the gear belt 98 for transmitting motor drive therefrom to the drive gear 92, and thus to the ejection roller shaft 58. The drive system 80 also includes a driven gear 100 mounted on the ejection roller shaft 58, a drive gear 102 mounted on the impression roller shaft 52, and a gear belt 104 which is looped about the gears, 100 and 102, for transmitting motor drive from the ejection roller shaft 58 to the impression roller shaft 52, and thus to the impression roller 50.

In operation, when a letter 24 (FIG. 1) is fed to the base 12, an edge thereof is urged into engagement with the registration fence 30 for guiding the letter 24 downstream in the path of travel 28, into the slot 22 between the base 12 and postage meter 16, and thus into engagement with the trip lever 34. The force exerted by the letter 24 against the trip lever 34 causes the lever 34 to move. Whereupon, the trip structure 84 causes the control system to energize the motor 86 for rotating the postage printing structure 40 through a single revolution. Upon energization of the motor 86, the motor output shaft 88 drives the pinion gear 90, thereby driving the gear belt 98 for rotating the ejector roller shaft 58, impression roller 50 and postage printing structure 40. As the impression roller 50 feeds the letter 24 downstream in the path of travel 28 beneath the drum 42, the printing die 44 rotates through a predetermined circularly-extending path of travel 106 and into engagement with the letter 24, followed by cooperating with the impression roller 50 to feed the letter 24 therebetween and to the ejection and idler rollers, 56 and 70, as the printing die 44 prints postage indicia on the letter 24. Thereafter, the ejection roller 56 also feeds the letter 24 downstream in the path of travel 28, and, in addition, stores excess energy in the ejection roller spring 57 until the upstream, trailing edge of the letter 24 is released due to the drum 42 rotating out of engagement with the letter 24. Whereupon, the excess energy stored in the ejection roller spring 57 rapidly rotates the outer roller member 56 in engagement with the letter 24, for ejecting the letter 24 from the machine 10.

According to the invention, the base 12 (FIG. 1) and thus the mailing machine 10, also includes a receptacle 110, formed in the housing 14, and a disposable inking cartridge 112, removably mountable in the receptacle 110.

Figure 2:
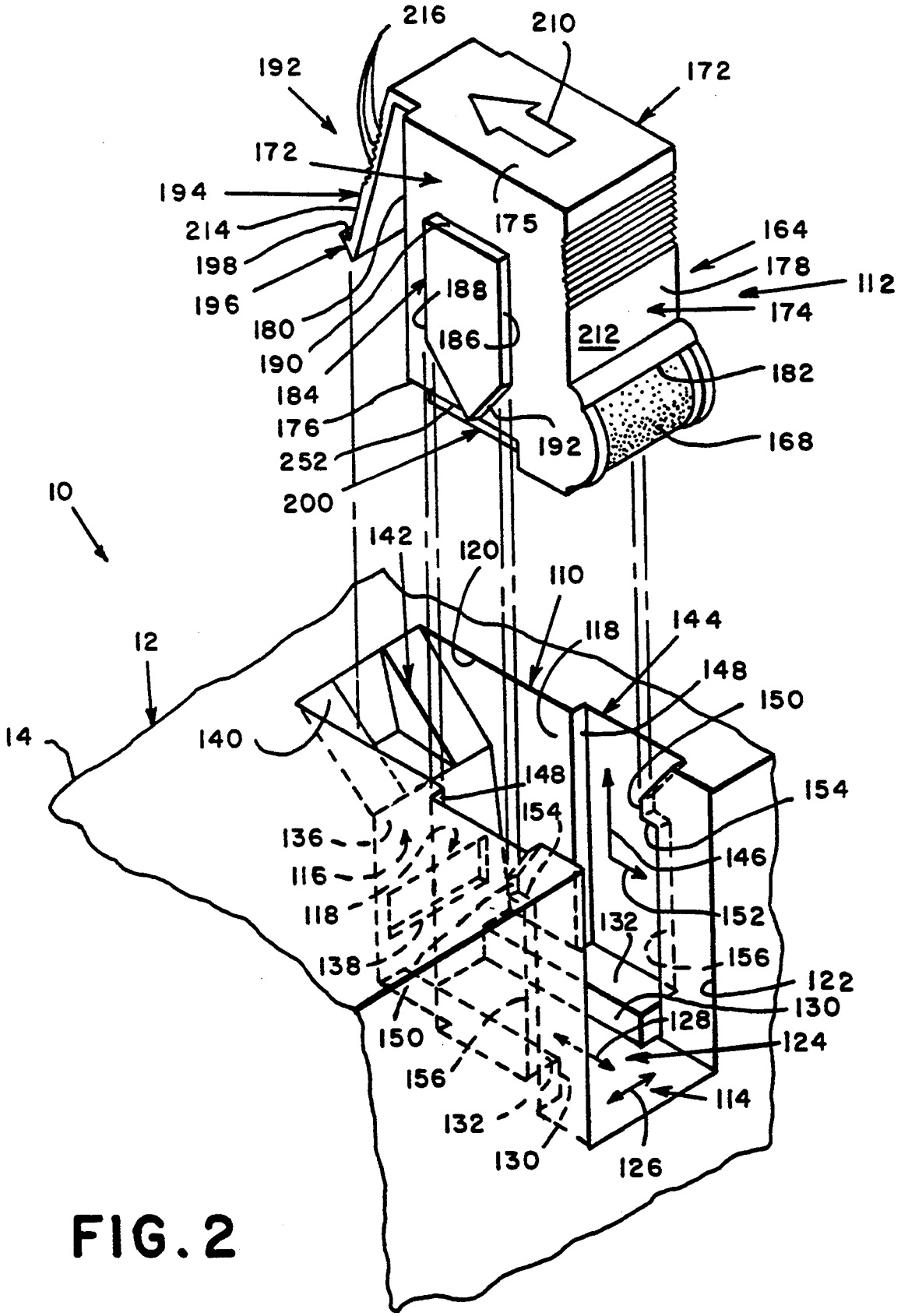
FIG. 2 is a partially fragmented, exploded, perspective view of the mailing machine of FIG. 1, showing the inking cartridge and a receptacle formed in the base for removably receiving the cartridge.

The receptacle 110 (FIG. 2) is preferably an elongate, substantially vertically oriented slot-like cavity defined in the housing 14 by mean of a lower wall 114, and by means of a rear wall 116 and oppositely facing side walls 118 which respectively extend upwardly from the lower wall 114 and define an open upper end 120, opposite the lower wall 114, and a front opening 122, opposite the rear wall 116. The lower wall 114 preferably includes a T-shaped channel 124 formed therein, including a laterally-extending front portion 126, intersected by an elongate, rearwardly-extending, rear portion 128, having a pair of elongate oppositely facing side surfaces 130. In addition, the lower wall 114 includes a pair of elongate, parallel-spaced, horizontally-extending base surfaces 132, from which the channel side surfaces 130 downwardly extend. The rear wall 116 includes a vertically-extending lower portion 136, having a rectangularly-shaped aperture 138 formed therein. In addition, the rear wall 116 includes an upper portion 140, which is inclined upwardly and rearwardly from the lower portion 136 to the receptacle's upper open end 120, and has a slot 142 formed downwardly and rearwardly therein. The opposed side walls 118 each include a substantially L-shaped channel 144 formed therein, having a vertically extending leg 146 defined by oppositely facing side surfaces, 148 and 150, and having a horizontally extending leg 152 defined by an upper, horizontally-extending, lip surface 154 and by one of the lower wall base surfaces 132. In addition, each of the opposed side walls 118 includes a stop surface 156 which vertically extends between the lip and base surfaces, 154 and 132.

The cartridge 112 (FIG. 2) generally includes a hollow housing 164 having rotatably mounted therein an ink impregnated reservoir roller 166 (FIG. 3 ) and an ink impregnated transfer roller 168. The housing 164 (FIG. 2) is preferably an elongate, upright, generally rectangularly-shaped, structure, having opposed, upright side walls 172, and having an elongate perimeter edge wall 174 which extends between the side walls 172. Preferably, each of the side walls 172 includes a cam-shaped portion 173, which is oppositely spaced from the cam-shaped portion 173 of the other side wall 172 and has an arcuately-extending cam surface 175 which radially extends outwardly of the edge wall 174 of the housing 164. The rollers, 166 and 168 (FIG. 3) respectively extend between the side walls 172, are rotatably connected thereto and are disposed in rolling engagement with one another. Moreover, the transfer roller 168, is preferably rotatably connected to the side walls 172 so as to extend between the cam-shaped portions 173 within the housing 164, such that the oppositely-spaced cam surfaces 175 radially extend marginally beyond the outer peripheral surface 169 of the transfer roller 168. The edge wall 174 (FIG. 2) includes upper and lower edge wall portions, 175 and 176, and includes oppositely spaced front and rear edge wall portions, 178 and 180, extending between the upper and lower edge wall portions, 175 and 176. Preferably, the front edge wall portion 178 extends downwardly from the upper edge wall portion 175 to the side wall cam surfaces 175 and defines, with the side walls 172, an arcuately-shaped aperture 182 formed in the housing 164 via which the outer peripheral surface 169 of the transfer roller 168 is readily accessible. As thus constructed and arranged, when the cartridge 112 (FIG. 5) is mounted in the receptacle 110, the transfer roller 168 is disposed for rolling engagement by the postage printing die 44 as the die 44 rotates into engagement with respective letters 24 in the path of travel 28.

For guiding manual insertion of the inking cartridge 112 (FIG. 2) into the receptacle 110, each of the side walls 172 includes an elongate, upright, generally rectangularly-shaped ridge 184 formed therein, substantially midway between the front and rear edge portions, 178 and 180, so as to extend laterally outwardly of the housing 164. Each of the ridges 184 has opposed, elongate, upright, parallel-spaced, front and rear guide edges, 186 and 188, and has an upper guide edge 190 extending transversely between the front and rear guide edges, 186 and 188. In addition, each of the ridges 184 has a V-shaped, downwardly pointing, lower guide edge 192, extending between the front and rear guide edges, 186 and 188, for visually indicating the direction of insertion, and guiding insertion, of the housing 164, and thus the cartridge 112, into the receptacle 110. The cartridge 112 additionally includes spring structure 192 comprising an elongate, generally rectangularly-shaped, leaf spring 194, which is fixedly connected to or integrally formed with the housing 164 and has a free end 196. Preferably, the leaf spring 192 is integrally formed with the upper edge wall portion 175 of the housing 164 so as to extend outwardly thereof and downwardly therefrom, alongside of the rear edge wall portion 180, to permit resilient movement thereof toward and away from the housing's rear edge wall portion 180. And, the free end 196 of the spring 192 includes a latch portion 198 extending transversely therefrom.

Assuming the cartridge 112 (FIG. 2) is oriented relative to the receptacle 110 for insertion therein, the housing's opposed, lower, pointed, ridge edge 192 is oriented downwardly, and the housing's ridge edge, 186 is 188, are respectively vertically aligned with the receptacle's vertically oriented channel leg surfaces, 150 and 148. When the housing 164 is thus aligned with the receptacle 110, the free end 196 of the leaf spring 192 is located vertically above the inclined upper portion 140 of the receptacle's rear wall 116. As the cartridge 112 is gradually inserted into the receptacle 110, the ridge edges, 188 and 186, slidably engage the receptacle surfaces, 148 and 150, and the leaf spring 192 engages the receptacle's upper, inclined, rear wall portion 140 which gradually incrementally urges the leaf spring 194 towards housing's rear edge wall portion 180, causing energy to be gradually stored in the leaf spring 192 until the leaf spring's latch portion 198 slidably engages the receptacle lower rear wall portion 136. Thereafter, as the cartridge 112 is further lowered into the receptacle 110, the spring 192 releases sufficient energy to cause the latch portion 198 (FIG. 3) to be resiliently urged into the receptacle's lower rear wall portion aperture 138, for latching engagement therewith, to hold the cartridge 112 within the receptacle 110 against vertical movement out of the receptacle 112.

For further holding the cartridge 112 (FIG. 2) in the receptacle 110 and for guiding forward and rearward movement of the housing 164 within the receptacle 110, the housing 164 includes the aforesaid upper guide edges 190, and, in addition, the lower edge wall portion 176 of the housing 164 includes an elongate ridge 200 formed therein which is generally U-shaped in transverse cross-section. The ridge 200 longitudinally extends between the front and rear edge portions, 178 and 180, of the edge wall 174 and is located substantially midway between the opposed side walls 172. Moreover, the ridge 200 extends downwardly and outwardly of the housing 164, and has opposed, longitudinally-extending, side surfaces 252. When the cartridge 112 is sufficiently lowered into the receptacle 110 (FIG. 3), the housing's upper ridge edges 190 slidably engages the receptacle's upper lip surfaces 154, and the housing's lower edge portion 176 is disposed in sliding relationship with respect to the receptacle's base surfaces 132. Whereupon the cartridge leaf spring 192 releases sufficient stored energy to cause the leaf spring 192 to resiliently urge the housing 164 forwardly within the receptacle 110 until the housing's front edge portion 178 is urged into engagement with the receptacle's stop surfaces 156.

Figure 3:
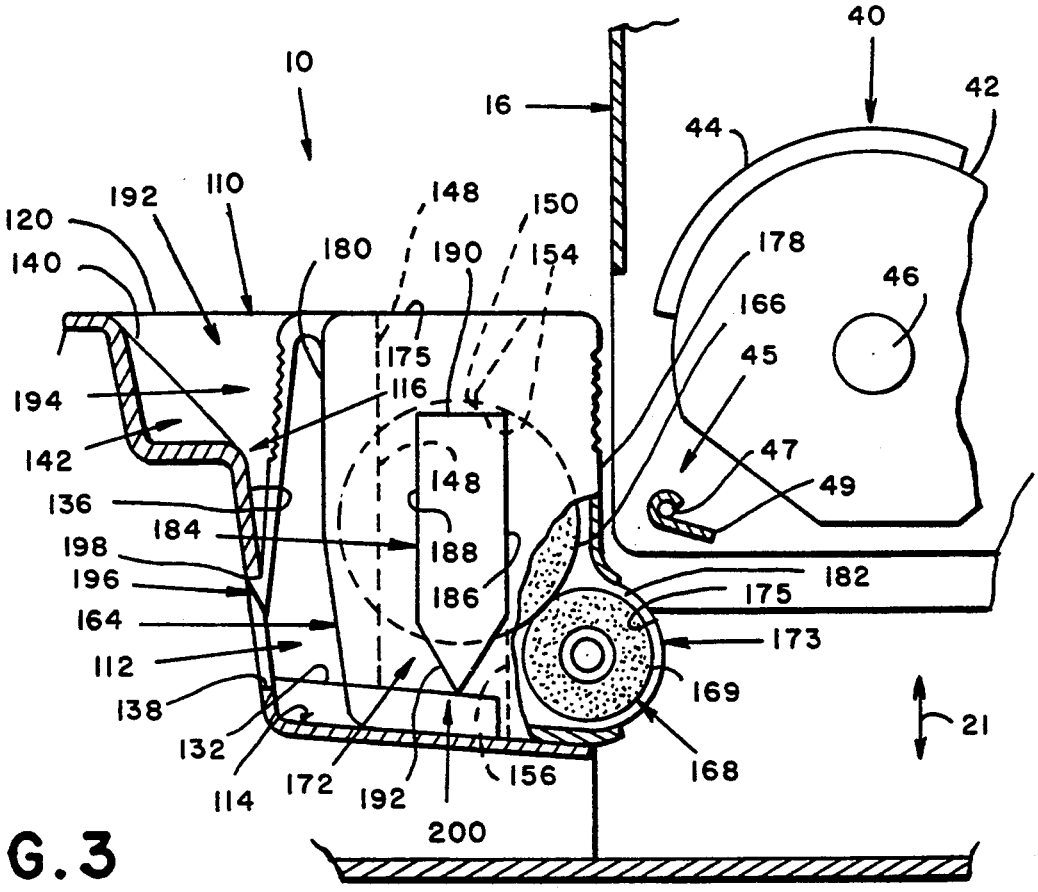
FIG. 3 is a partial elevation view of the mailing machine of FIG. 1, showing the postage meter disposed out of engagement with the inking cartridge.
Figure 4:
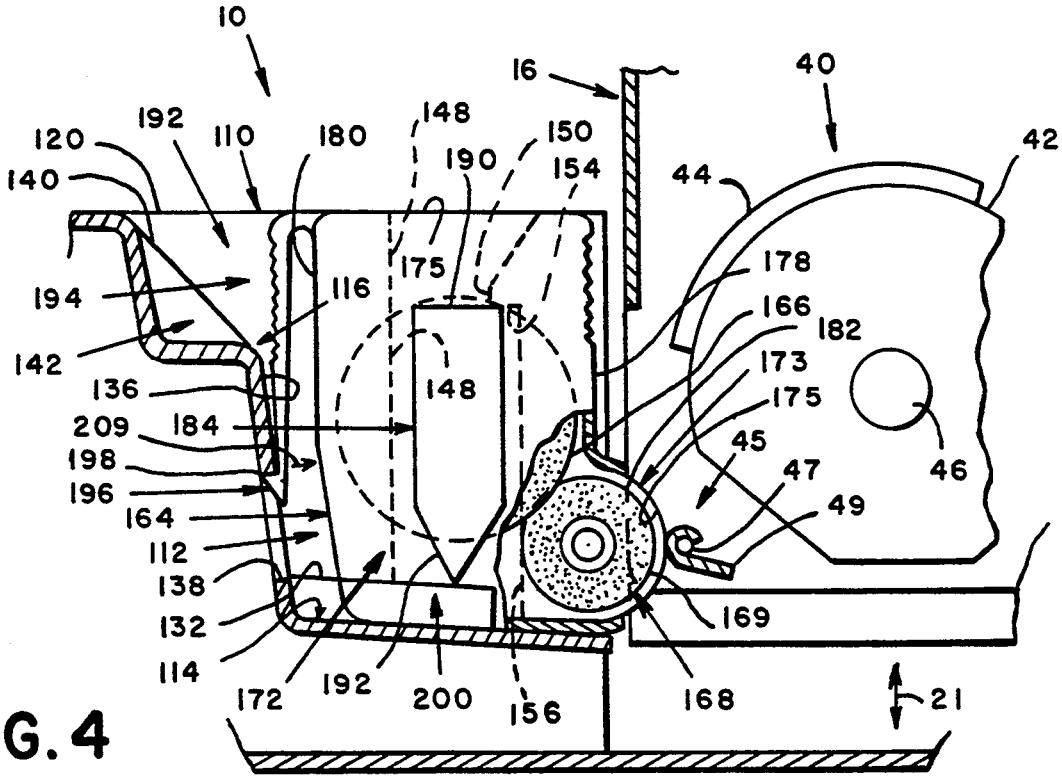
FIG. 4 is a partial elevation view of the mailing machine of FIG. 1, showing the postage meter engaging the cartridge in the course of mounting the meter on, or dismounting the meter from, the mailing machine.
Figure 5:
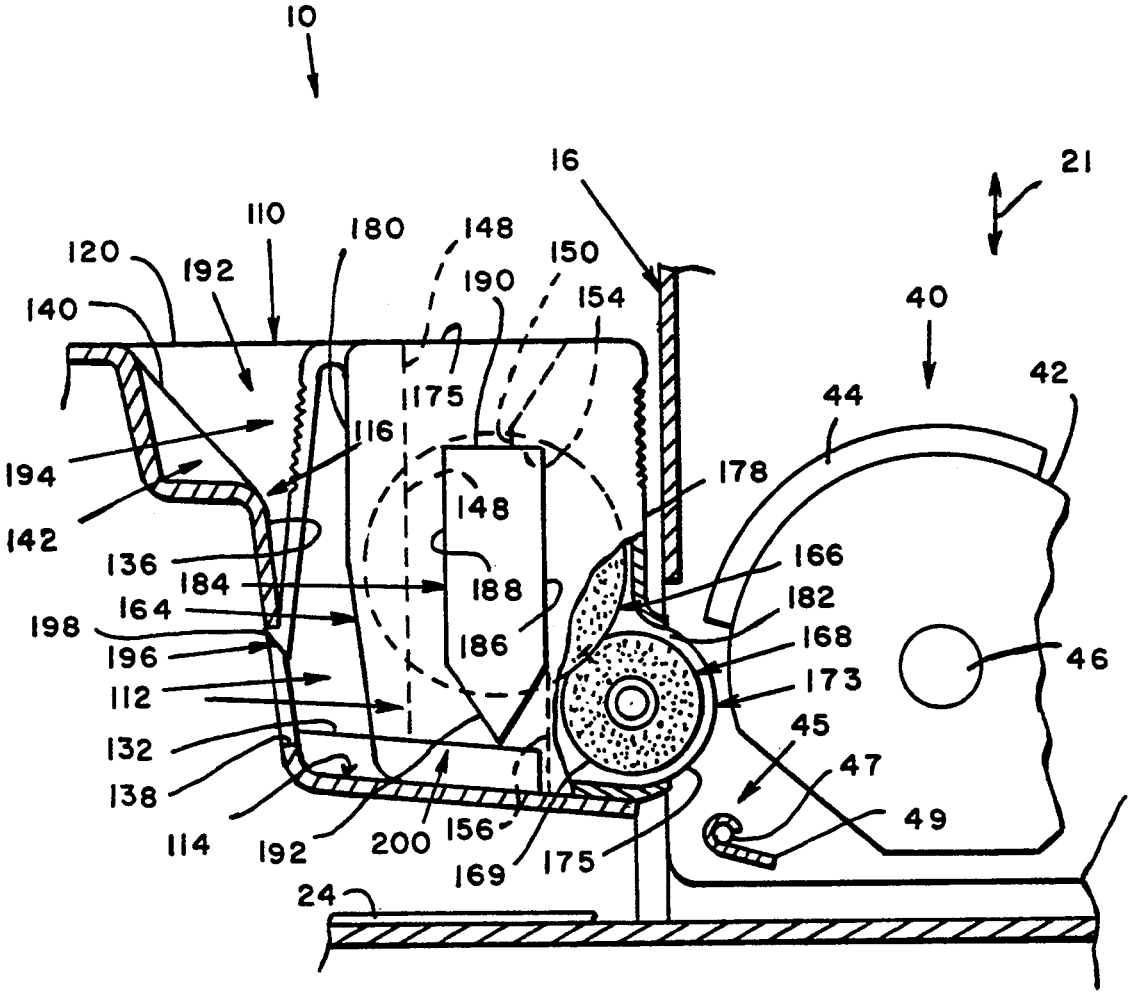
FIG. 5 is a partial elevation view of the mailing machine of FIG. 1, showing the postage meter mounted on the mailing machine's base.

For mounting the postage meter 16 (FIG. 1) on the base 12, the postage meter apertures 20 and mailing machine base posts 18 are respectively aligned with each other and the postage meter 16 is vertically lowered, in the path of travel 21 defined by the apertures 20 and posts 18 to the predetermined position 17 thereof on the base 12. As shown in FIG. 3, when the cartridge 112 is mounted in the receptacle 110, the cam-shaped portions 173 thereof are located in the path of travel 21 of the postage meter 16. In addition, the meter guard structure 45 is located in the meter's path of travel 21. As the postage meter 16 is lowered onto the base 12 (FIG. 4) the shield member 49, is lowered into engagement with the cartridge's cam surfaces 175. And, in response to the shield member 49 engaging the cam surfaces 175, the shield member 49 urges the housing 164 out of engagement with the receptacle stop surfaces 156 and rearwardly within the receptacle 112, against the forwardly directed resilient force 209 exerted by the leaf spring 194. As a result, since the transfer roller 168 is carried by housing 164 therewith, the transfer roller 168 is urged out of the path of travel 21 of the postage meter 16 in response to the guard structure 45 engaging the cartridge 116. Thus the guard structure 45 prevents ink from the transfer roller 168 from being smeared onto the postage meter 16 as the postage meter 16 is mounted on the base 12. As shown in FIG. 5 when the postage meter 16 lowered onto the base 16 the guard structure 45 is disposed of engagement with the cam surfaces 175 and the leaf spring 194 has resiliently urged the housing 164, and thus transfer roller 168, toward the printing die 44 to permit ink to be transferred from the roller 168 to the printing die 44 when the printing die 44 rotates into engagement with the transfer roller 168. Thus the leaf spring 194 resiliently urges the housing 164 forwardly within the receptacle 110 and back out into engagement with the receptacle's stop surfaces 156 in response to the guard structure 45 disengaging the cam surfaces 175. As the housing 164 is thus reciprocably moved within the receptacle 110 in response to the guard structure 45 engaging and disengaging the cam surfaces 175, the housing's opposed ridge edges 190 slidably move against the receptacle's upper lip surfaces 154, and the housing's lower edge portion 176 slidably moves against the receptacle's lower wall base surfaces 132, for guiding movement of the housing 164 within the receptacle 110.

When the postage meter 16 (FIG. 5) is mounted on the base 12, the meter apertures 20 (FIG. 1) and base posts 18 are disposed in alignment with one another and the postage meter 16 is located in the predetermined position 17 thereof on the base 12. For dismounting the postage meter 16 from the base 12 the meter 16 is vertically raised in the path of travel 21 defined by the apertures 20 and posts 18, out of the position 17 thereof on the base 12. Whereupon, the guard structure 45 (FIG. 4) engages the cam surfaces 175 and laterally moves the cartridge housing 164 out of engagement with the receptacle stop surfaces 156 and rearwardly within the receptacle 110, against the force 209 exerted by the spring 194. And, as the postage meter 16 is further vertically moved away from the base 12, the guard structure 45 (FIG. 3) is moved out of engagement with the cam surfaces 175. Whereupon, the leaf spring 194 laterally moves the cartridge housing 164 forwardly within the receptacle 110 and into engagement with the receptacle stop surfaces 156.

In accordance with the objects of the invention there has been described improved letter processing apparatus. More particularly, there has been described a mailing machine having a base and including a removably mountable postage meter and a removably mountable inking cartridge, wherein the inking cartridge is movable by a postage meter when the postage meter is mounted on the base.

What is claimed is:

1. A mailing machine comprising:

a. a base;

a postage meter removably mountable on the base;

the base and meter respectively including means for guiding the meter in a path of travel to a predetermined position on the base when mounting the meter thereon; and d. a disposable inking cartridge comprising:

i. a generally rectangularly-shaped hollow housing movably connected to the base, the housing having opposed side walls and having an elongate perimeter edge wall extending between the side walls, each of the side walls including an arcuately-shaped cam surface oppositely spaced from the cam surface of the other side wall, the cam surfaces and edge wall defining a substantially arcuately-shaped aperture formed in the housing; and ii. a transfer roller impregnated with printing ink and rotatably connected to the side walls so as to extend therebetween and be accessible via the housing aperture, and the cam surfaces located in the path of travel of the meter for engagement thereby to move the housing out of the path of travel and carry therewith the transfer roller as the postage meter is mounted on the base.

2. The mailing machine according to claim 1, wherein each of the opposed side walls includes a ridge portion laterally-extending therefrom, and each of the ridge portions including an edge thereof for guiding said movement of the housing.

3. The mailing machine according to claim 1, including a receptacle formed in the base, the cartridge removably mounted in the receptacle for movably connecting the housing to the base, the edge wall including opposed upper and lower portions, the edge wall including a side portion extending between the upper and lower portions, the cartridge including a spring extending from the housing and alongside of the side portion thereof for exerting a resilient force against the housing when the cartridge is mounted in the receptacle, and the postage meter urging the housing against the force exerted by the spring when the postage meter engages the cam surfaces, whereby the housing and thus the transfer roller is urged away from the meter against the force exerted by the spring as the meter is mounted on the base.

4. The mailing machine according to claim 1, wherein the side walls are slidably disposed in engagement with the base when the cartridge is connected thereto.

5. The mailing machine according to claim 1 including a receptacle formed in the base, the receptacle including a pair of oppositely facing upright side walls, each of the receptacle side walls including a substantially horizontally-extending channel formed therein which oppositely faces the channel formed in the oppositely facing receptacle side wall, and the housing slidably movable within the channels for guiding movement thereof within the receptacle when the postage meter engages the cam surfaces.

6. The mailing machine according to claim 3, wherein the receptacle includes an upright rear wall having an aperture formed therein, and the spring disposed in the rear wall aperture when the cartridge is mounted in the receptacle for latching engagement with the receptacle rear wall.

7. The mailing machine according to claim 5, wherein each of the housing side walls includes a ridge extending therefrom and into an opposite one of the receptacle channels for guiding reciprocal movement of the housing within the receptacle in response to engagement and disengagement of the cam surfaces by the postage meter.

8. The mailing machine according to claim 3, wherein the receptacle has a lower wall, and the housing edge wall including a lower portion thereof disposed in sliding engagement with the receptacle lower wall.

9. The mailing machine according to claim 3, wherein the receptacle includes oppositely facing side walls, each of the receptacle side walls including a channel formed therein and oppositely facing the channel formed in the other receptacle side wall, and the opposite channels guiding movement of the housing within the receptacle in response to engagement and disengagement of the cam surfaces by the postage meter.

10. The mailing machine according to claim 3, wherein the receptacle includes a pair of upright stop surfaces against which the housing is urged by the spring when the cartridge is mounted in the receptacle, the housing slidably movable out of engagement with the stop surfaces in response to engagement of the cam surfaces by the meter, and the housing slidably movable into engagement with the stop surfaces in response to disengagement of the cam surfaces by the meter.

11. A mailing machine comprising:

a. a base;

b. a postage meter mountable on and dismountable from the base;

c. the base and meter respectively including means for guiding the meter in a path of travel out of a predetermined position on the base when dismounting the meter therefrom; and d. a disposable inking cartridge comprising:

i. a generally rectangularly-shaped hollow housing movably connected to the base, the housing having opposed side walls and having an elongate perimeter edge wall extending between the side walls, each of the side walls including an arcuately-shaped cam surface oppositely spaced from the cam surface of the other side wall, the cam surfaces and edge wall defining a substantially arcuately-shaped aperture formed in the housing; and ii. a transfer roller impregnated with printing ink and rotatably connected to the side walls so as to extend therebetween and be accessible via the housing aperture, and the cam surfaces located in the path of travel of the meter for engagement thereby to move the housing out of the path of travel and carry therewith the transfer roller as the postage meter is dismounted from the base.

12. The mailing machine according to claim 11, wherein each of the opposed side walls includes a ridge portion laterally-extending therefrom, and each of the ridge portions including an edge thereof for guiding said movement of the housing.

13. The mailing machine according to claim 11, including a receptacle formed in the base, the cartridge removably mounted in the receptacle for movably connecting the housing to the base, the edge wall including opposed upper and lower portions, the edge wall including a side portion extending between the upper and lower portions, the cartridge including a spring extending from the housing and alongside of the side portion thereof for exerting a resilient force against the housing when the cartridge is mounted in the receptacle, and the postage meter urging the housing against the force exerted by the spring when the postage meter engages the cam surfaces, whereby the housing and thus the transfer roller is urged away from the meter against the force exerted by the spring as the meter is dismounted from the base.

14. The mailing machine according to claim 11, wherein the side walls are slidably disposed in engagement with the base when the cartridge is connected thereto.

15. The mailing machine according to claim 11 including a receptacle formed in the base, the receptacle including a pair of oppositely facing upright side walls, each of the receptacle side walls including a substantially horizontally-extending channel formed therein which oppositely faces the channel formed in the oppositely facing receptacle side wall, and the housing slidably movable within the channels for guiding movement thereof within the receptacle when the postage meter engages the cam surfaces.

16. The mailing machine according to claim 13, wherein the receptacle includes an upright rear wall having an aperture formed therein, and the spring disposed in the rear wall aperture when the cartridge is mounted in the receptacle for latching engagement with the receptacle rear wall.

17. The mailing machine according to claim 15, wherein each of the housing side walls includes a ridge extending therefrom and into an opposite one of the receptacle channels for guiding reciprocal movement of the housing within the receptacle in response to engagement and disengagement of the cam surfaces by the postage meter.

18. The mailing machine according to claim 13, wherein the receptacle has a lower wall, and the housing edge wall including a lower portion thereof disposed in sliding engagement with the receptacle lower wall.

19. The mailing machine according to claim 13, wherein the receptacle includes oppositely facing side walls, each of the receptacle side walls including a channel formed therein and oppositely facing the channel formed in the other receptacle side wall, and the opposite channels guiding movement of the housing within the receptacle in response to engagement and disengagement of the cam surfaces by the postage meter.

20. The mailing machine according to claim 13, wherein the receptacle includes a pair of upright stop surfaces against which the housing is urged by the spring when the cartridge is mounted in the receptacle, the housing slidably movable out of engagement with the stop surfaces in response to engagement of the cam surfaces by the meter, and the housing slidably movable into engagement with the stop surfaces in response to disengagement of the cam surfaces by the meter.

* * * * *